US012496483B2

(12) United States Patent
Miller

(10) Patent No.: US 12,496,483 B2
(45) Date of Patent: Dec. 16, 2025

(54) PORTABLE GRAVITY BASED AND BODYWEIGHT EXERCISE DEVICE

(71) Applicant: Daniel Miller, Honolulu, HI (US)

(72) Inventor: Daniel Miller, Honolulu, HI (US)

(73) Assignee: Daniel Miller, Honolulu, HI (US)

( * ) Notice: Subject to any disclaimer, the term of this patent is extended or adjusted under 35 U.S.C. 154(b) by 0 days.

(21) Appl. No.: 18/267,448

(22) PCT Filed: Dec. 13, 2021

(86) PCT No.: PCT/US2021/063087

§ 371 (c)(1),
(2) Date: Jun. 14, 2023

(87) PCT Pub. No.: WO2022/132637

PCT Pub. Date: Jun. 23, 2022

(65) Prior Publication Data

US 2024/0050797 A1 Feb. 15, 2024

Related U.S. Application Data

(60) Provisional application No. 63/125,008, filed on Dec. 14, 2020.

(51) Int. Cl.

| | |
|---|---|
| ***A63B 21/068*** | (2006.01) |
| ***A63B 21/00*** | (2006.01) |
| ***A63B 23/12*** | (2006.01) |

(52) U.S. Cl.

CPC ..... *A63B 21/068* (2013.01); *A63B 21/00047* (2013.01); *A63B 21/4035* (2015.10); *A63B 23/1218* (2013.01); *A63B 23/1227* (2013.01); *A63B 2210/50* (2013.01)

(58) Field of Classification Search

CPC ..... A63B 21/068; A63B 21/00047; A63B 21/4035; A63B 23/1218; A63B 23/1227; A63B 2210/50; A63B 21/065; A63B 21/4005; A63B 23/1281; A63B 21/16; A63B 23/0355; A63B 1/00

See application file for complete search history.

(56) References Cited

U.S. PATENT DOCUMENTS 6,062,974 A * 5/2000 Williams ..... A22B 5/06 452/187
6,695,688 B1 * 2/2004 Owen ..... A22B 5/06 452/187

(Continued)

*Primary Examiner* — Andrew S Lo
(74) *Attorney, Agent, or Firm* — Pia Hoyt LLP; Steven Gray

(57) ABSTRACT

An article for performing exercise that may include an attacher piece to attach to an elevated object and an extender piece to extend a horizontal distance from the elevated object while the attacher piece is attached to the elevated object and while the extender piece is connected to the attacher piece. The article may also include a weight suspension piece to suspend a body of weight therefrom while the weight suspension piece is connected to the extension piece. The article may also include a supporter piece configured to extend from at least one of the extender piece and the weight suspension piece to apply force against the elevated object, thereby providing additional support for the suspension of the body of weight from the weight suspension piece.

20 Claims, 9 Drawing Sheets

(56) References Cited

U.S. PATENT DOCUMENTS

| | | | | |
|---|---|---|---|---|
| 7,341,507 | B1 * | 3/2008 | Julian, Sr. | A22B 5/06 452/192 |
| 7,913,980 | B1 * | 3/2011 | Cipriano | B66D 3/08 452/187 |
| 8,302,922 | B1 * | 11/2012 | Robinson | A47G 25/08 248/219.4 |
| 8,915,774 | B1 * | 12/2014 | Hunter | A22B 5/06 452/187 |
| 9,161,526 | B2 * | 10/2015 | Nipper | A01M 31/02 |
| D754,405 | S * | 4/2016 | Herde | D30/121 |
| 2003/0178255 | A1 * | 9/2003 | Auer | A01M 31/00 182/187 |
| 2011/0049315 | A1 * | 3/2011 | Buckbee | A45F 5/00 248/219.4 |
| 2016/0324717 | A1 * | 11/2016 | Burton | A61H 7/001 |
| 2017/0354838 | A1 * | 12/2017 | Fitzpatrick | A63B 1/00 |
| 2018/0207463 | A1 * | 7/2018 | McGhee | A63B 23/1218 |

* cited by examiner

PORTABLE GRAVITY BASED AND BODYWEIGHT EXERCISE DEVICE

BACKGROUND

Physical exercise is any bodily activity that enhances or maintains physical fitness and overall health and wellness. It is performed for various reasons including strengthening muscles and the cardiovascular system, honing athletic skills, weight loss or maintenance, as well as for the purpose of enjoyment. Frequent and regular physical exercise boosts the immune system, and helps prevent the "diseases of affluence," such as heart disease, cardiovascular disease, Type 2 diabetes and obesity. It also improves mental health, eases depression and anxiety, boosts energy and mood, and relieves stress.

Exercise equipment is used during physical activity to enhance the strength or conditioning effects of that exercise by providing either fixed or adjustable amounts of resistance, target certain muscle groups, or to otherwise enhance the experience or outcome of an exercise routine. Exercise equipment can be fixed or portable and are of various types namely free weights such as dumbbells, kettle bells, barbells; resistance bands; weight machines; flexion machines; and pull-up bars.

SUMMARY

Described herein, according to at least embodiment, is an article or device for performing exercise. In some examples, the article may include a first or attacher piece for attaching to an elevated object. In some examples, the article may include a first or attacher piece that may be configured to attach to the elevated object at a first vertical coordinate. In some examples, the article may also include a second or extender piece connected to the first or attacher piece. In some examples, the second or extender piece may be configured to extend a horizontal distance from the elevated object while the first or attacher piece is attached to the elevated object, and while the extender piece is connected to the attacher piece.

In some examples, the article may also include a third or weight suspension piece for suspending a weight or a body of weight therefrom. In some examples, the third or weight suspension piece may be connected to the second or extender piece.

In some examples, the article may also include a fourth or supporter piece configured to extend from a second vertical coordinate at or below the first vertical coordinate to a third vertical coordinate below the second vertical coordinate. The fourth or supporter piece may further be configured to provide additional support for the suspension of the body of weight from the weight suspension piece. In some examples the fourth or supporter piece may be attached to and extend from at least one of the second or extender piece and the third or weight suspension piece.

In some examples of the article, the fourth or supporter piece may be configured to extend from the at least one of the second or extender piece and the third or weight suspension piece at an angle from the horizontal axis of the second or extender piece, while the second or extender piece may extend a horizontal distance from the elevated object, while the first or attacher piece is attached thereto. In some examples, the angle may be in a range of 15 to 75 degrees.

In some examples of the article, the second or extender piece may extend the horizontal distance from the elevated object at a fourth vertical coordinate at or above the second vertical coordinate. In some examples, the extender piece may not extend vertically below the second vertical coordinate. In some examples, the horizontal angle may include a range of 85 degrees to 95 degrees from a vertical axis of the elevated object.

In some examples, of the article, the second or extender piece may have a proximal end and a distal end opposite the proximal end, and the first or attacher piece may be connected to the proximal end of the second or extender piece, and wherein the third or weight suspension piece may be connectable or connected to the second or extender piece at the distal end of the second or extender piece.

In some examples of the article, the fourth or supporter piece may be configured to apply force on the elevated object at the third vertical coordinate. In some examples, the supporter piece may be further configured to apply the force against the elevated object by at least some direct contact with the elevated object at the third vertical coordinate.

In some examples of the article, the first or attacher piece and the extender or second piece may be separate pieces. In other examples, the first or attacher piece and the extender or second piece may be uniform. In some examples of the article, the second or extender piece and the weight suspension or third piece may be separate pieces. In some examples of the article, the third or weight suspension piece may configured to be aligned horizontally perpendicular from the second or extender piece.

In some examples, the third or weight extension piece may include at least a first pair of hand grips. In some examples, the third or weight extension piece may include a sturdy bar. In some examples, the sturdy bay may include a first end and a second end opposite the first end. In some examples, the at least a first pair of hand grips may include a firsthand grip and a corresponding second hand grip; and the first end of the sturdy bar may include the first hand grip and the second end of the sturdy bar may include the second hand grip. In some examples, the at least a first pair of hand grips may include a first pair of hand grips and a second pair of hand grips. In some examples, each hand grip of a first pair (or of a second pair) of the at least a first pair of hand grips may be attached to a pair of extending rod portions associated with the sturdy bar and configured to extend in a substantially similar direction as the extender piece, and/or to horizontally-perpendicular aligned positions with respect to the sturdy bar.

In some examples of the article, the first or attacher piece may be configured to form a loop to wrap around the elevated object. In some examples, the first or attacher piece may include a first end and a second end. In some iterations, the first end may be attachable to the second end to form the loop. In some instances, the attacher piece may also include a tightener. In some examples, the tightener may be associated with one or both of the first end and the second end.

In some examples of the article, the fourth or supporter piece may be foldable. In some iterations, the fourth or supporter piece may be foldable into the plane of the second extender piece.

The above-described embodiments are considered that of some embodiments only. It is understood that the embodiments shown in the drawings below and described above are merely for illustrative purposes and not intended to limit scope. Therefore, alterations, modifications, and such further applications as would occur to those skilled in the relevant art(s) are also contemplated.

DETAILED DESCRIPTION

Figure 1:
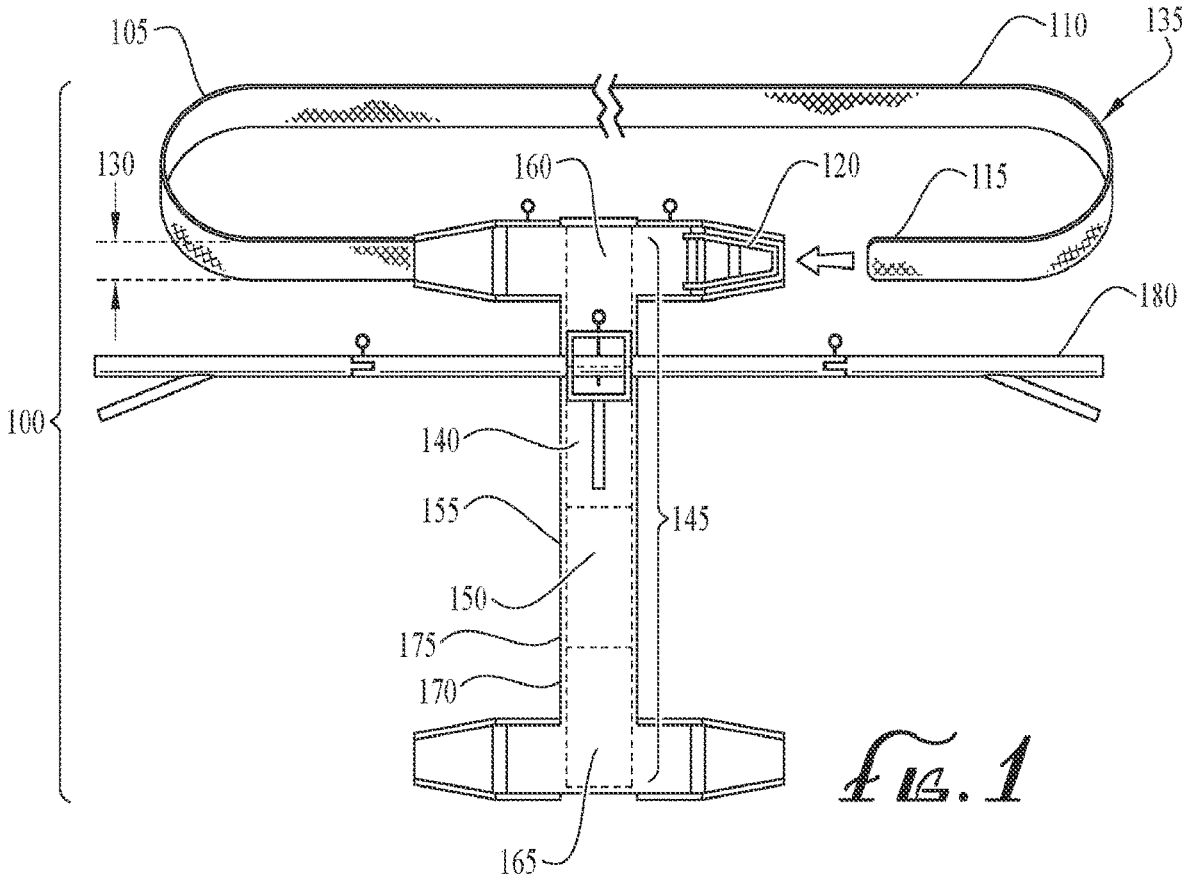
FIG. 1 illustrates a front view of an exercise device embodiment in accordance with various aspects of this disclosure.

There are several problems with most traditional exercise equipment. First, some equipment may be bulky and hard for a person to transport any significant distance on foot. A second problem may be the limitation on the number of exercises that can be performed with a particular device. Often, a user can only perform one or more exercises using a single device. Thus, for each exercise a user may have to purchase a different machine or device. But it is very difficult for a user to take all the separate devices with him if he/she is moving from one place to another (especially if moving on foot). This further makes the user unable to continue his/her routine exercises in certain conditions/environments.

Take, for instance, a person performing aerobic exercise by walking or hiking in the outdoors who desires, but is unable, to perform several device-enabling exercises along the walk or hike. Although the person may not be able to carry such devices or exercise machines along the hike, or even formal exercise weights, the person will naturally still have the weight of her or his own body. Bodyweight exercises may use a person's own weight to provide resistance for the exercise movement.

Bodyweight exercises have certain advantages over other types of exercises. For example, bodyweight exercises do not require weights and therefore are more easily performed where access to weights is limited. In addition, since bodyweight exercises provide resistance based on the force of gravity acting on a person's mass, and each person may be a different mass, exercises are tailored individually to each person (e.g., a larger person has more weight and a smaller person has less weight), unlike free weights or certain machines. However, if more resistance/weight is desired, weights can often still be incorporated into bodyweight exercises. Alternatively, many bodyweight exercises can be modified to decrease resistance or intensity, by for example, adjusting the position of a person or angle with the ground.

Bodyweight exercises are also advantageous for pedestrian portability because, since a person is already transporting his/her own body weight, a person need not transport additional weight in order to obtain a resistance equal to his/her bodyweight. In addition, bodyweight exercises can be advantageous in that they often require more flexibility and balance than other types of exercises, and may often engage several different muscles instead of isolating simply one particular muscle or set of muscles, as is often the case with other types of exercises.

A few common bodyweight exercises, for example, are push-ups, handstand push-ups, sit-ups, dips, and pull-ups. Some bodyweight exercises either require certain equipment to be performed, or can be performed more conveniently or have more amplified application when used with equipment. Bodyweight exercise equipment may often require some firm structure stably connected or mounted to the ground to provide stability while the body moves to perform the exercise. For example, pull-ups are a common exercise for strengthening primarily the latissimus dorsi, but also the shoulders, arms, forearms, hands, pelvic floor and other muscles. Pull-ups are usually performed by spacing the hands a certain distance apart along a horizontally aligned bar that is suspended in the air by being fixed to some object or structure that has some vertical support structure with a base resting on a ground surface, and gripping the bar, and then pulling the body upward so that the chin clears the bar, and then lowering the body until the arms and shoulders are extended, and then pulling the body upward again.

Similar to pull-ups, dips often require handles for gripping that are also suspended in air, which are also attached to some vertical support structure resting stably on a ground surface. Like many other pieces of exercise equipment, equipment for performing bodyweight exercises may often be bulky and difficult to transport.

Although some portable pull-up bars exist, those devices have drawbacks. For example, some portable pull-up bars have applications that are somewhat limited or otherwise disadvantageous. Several disadvantage may result, for example, from the requirement that a pull-up bar attach to a door frame. Specifically, such a requirement might entail limited space for the performance of the pull-up exercise, and/or result in a person's body hitting the sides of the door frame, or the person's head inadvertently bumping against the top of the door frame or a ceiling, or damaging the door frame, or render the bar unusable where there are no available doorframes (as is often the case in outdoor locations). Other portable devices may require carrying, in addition to the horizontal bar, a cumbersome vertical structure that may hold the horizontal bar suspended in the air. For example, some such portable devices may feature collapsible vertical poles to provide a vertical support structure to which the pull-up bar may fasten and be suspended in air, and such poles may often be bulky and difficult to transport.

While a few limited devices may allow fastening to vertical objects, they have only recently been developed, and may suffer drawbacks in design. For instance, the design of such devices may entail placing a great deal of downward force on the point where the device attaches to the vertical object. Such a design may potentially lead to excessive wear and tear on the device, lead to instability while exercises are being performed, or require an excessive amount of bulky material (which may be need to transported) to compensate for the aforementioned potential deficiencies. In any event, there still exists a need for improvements to such a category of devices.

In order to overcome one or more of the aforementioned problems, the subject invention assists a user perform pull-ups and other gravity-based resistance exercises. At least some of the resistance necessary for such gravity-based resistance exercises may be provided by the user's own bodyweight. More specifically, the device may allow using vertical (i.e., plumb) objects to assist in performing pull-ups and other gravity-based resistance exercises that require fixed and elevated bar, handles, etc. Examples of such vertical objects are those commonly found outdoors and may include trees, poles, and other vertical objects around which a loop may fasten.

FIG. 1 shows an example of such a device 100, in accordance with various aspects of this disclosure. The device 100 may have a first piece 105 (or attached piece) for attaching to an elevated object (not shown in FIG. 1). In some examples, the first piece 105 may attach to the object based at least in part on forming a loop 110 around the object in some examples, the first piece 105 may have a first end 115 and a second end 120, which ends 115, 120 may connect to form the loop 110.

In some examples, the first piece 105 may be configured to securely tighten around the object. For instance, the first end 115 may include a tightener, such as for example a ratchet 125. For embodiments incorporating ratchets, ratchet 125 may include a releasable locking mechanisms to assist in maintaining a securely fastened position for the duration of use. In some examples, the first piece 110 105 may be a strap 110 made of strong, flexible material (such as durable nylon). The first piece 110 105 may have a width 130. The range of the width 130 may vary, and in some instances may have a range of 0.4 to 10 inches, and in example may have greater than 3 inches. Thus, the device 100 may comprise a loop 110 wrap-able around a fixed vertical object The loop 110 of the first piece 105 may also have a length 135. The length 135 may also vary according to embodiment; for example, the length 135 may have a range from 10 inches to 10 feet. By way of further example, for some thicker objects, the length 135 of the loop 110 may be around six feet.

A second piece 140 (or extender piece) may extend from or be connected with the first piece 105. In some examples, the second piece 140 may be attached to the loop 110. Then, the second piece 140 may be configured to extend horizontally a distance 145 from the loop 110 and from the vertical object attached thereto. In some examples, the second piece 140 may have a top side 150 and a bottom side 155 and two opposite ends 160, 165 (a proximal end 160 and a distal end 165, and a body 170 in between the top side 150 and the bottom side 155 and the two opposite ends 160, 165. In some examples, all or part of the top side 150 and the bottom side 155 and the proximal end 160 and the distal end 165 and the body may be unitary. In some examples, the body 170 may have a length 145 between the two opposite ends 160, 165 that corresponds to the horizontally extending distance 145 when the first piece 110 105 is attached to the object as described in this disclosure. The body 170 may also have a thickness 175 between the top side 150 and the bottom side 155.

The second piece or extender piece 140 may be attached to a third piece or weight suspension piece 180. In one embodiment, the third piece or weight suspension piece 180 may include a horizontal bar. In one embodiment the third piece or weight suspension piece 180 may slidably attach to the second piece or extender piece 140 in a fixed and stable manner. For example, in one example, the third piece or weight suspension piece 180 may slide into a slot, hole, or groove in the or associated with the extender piece, and then lock into place (e.g., through a sliding pin). In some examples, the second or extender piece 140 and the weight suspension or third piece 180 may be uniform. In other examples, the second or extender piece 140 and the weight suspension or third piece 180 may be separate pieces.

Figure 2:
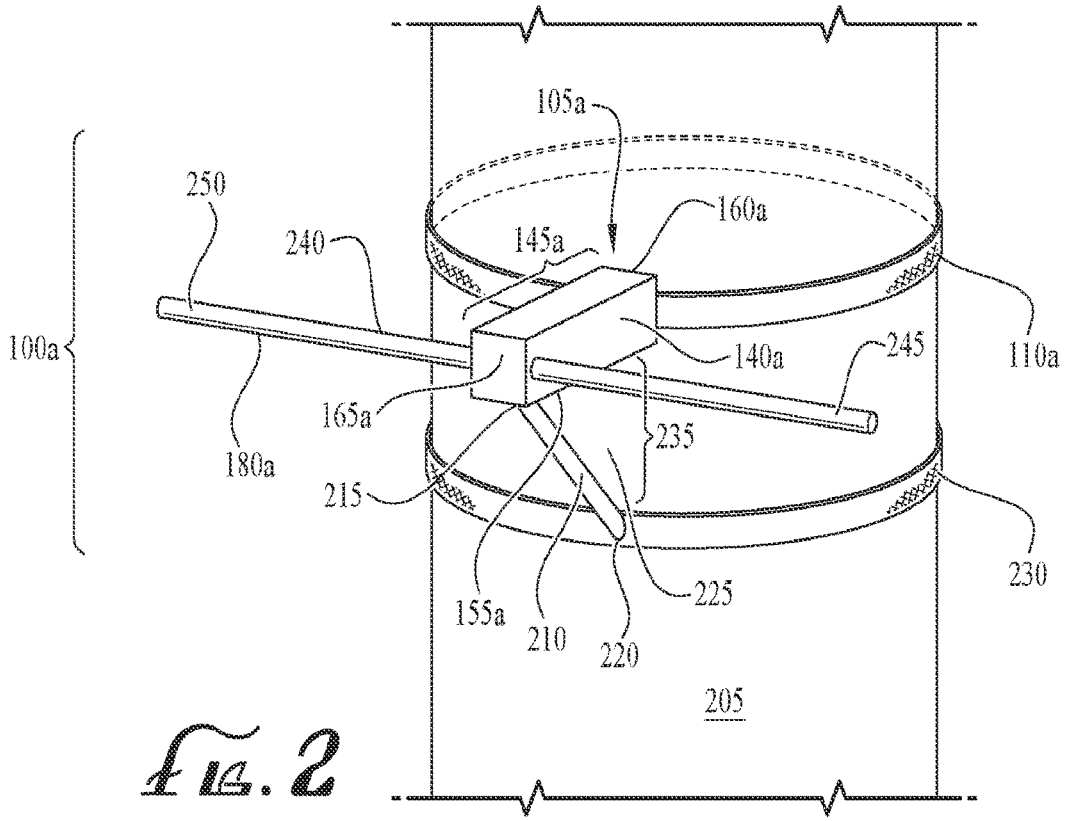
FIG. 2 illustrates a side view and a perspective side view, respectively, showing (among other things) a gusset of an exercise device embodiment in accordance with various aspects of this disclosure.

FIG. 2 shows the device 100*a* attached to a vertical object 205, in accordance with various aspects of this disclosure. More specifically, the first or proximal end 160*a* of the second piece or extender piece 140*a* may be attached to the loop 110 so that the second piece or extender piece 140*a* may be configured, in one embodiment, to extend at substantially a right angle from the vertical object 205 (so that it is substantially perpendicular to the vertical object 205, or substantially parallel to a level ground to which the vertical object 205 is fixed). In some examples, the second piece or extender piece 140*a* may extend at angle in the range of 60 degrees to 120 degrees from the vertical object. In some examples, the second piece or extender piece 140*a* may extend at angle in the range of 80 degrees to 100 degrees from the vertical object. In some examples, the second piece or extender piece 140*a* may extend at angle in the range of 85 degrees to 95 degrees from the vertical object 205. In some examples, the second piece or extender piece 140*a* may extend to be virtually parallel to a flat ground or floor to which the vertical object 205 may be attached.

In some examples, the wrapping of or placing the loop 110*a* around the vertical object 205 may ensure the secure fixture of the device 10*a* to the vertical object 205. In some examples (where the first or attacher piece 105*a* includes a strap 110*a*), the second or extender piece 140*a* may be suspended in air and jut horizontally a distance 145*a* away from the strap 110*a* and the vertical object 205.

Furthermore, in one embodiment, this horizontal orientation may be preserved with the assistance of a fourth or supporter piece 210. In some examples, the fourth or supporter piece 210 may provide additional support for suspending a weight or body of weight from the third or weight suspension piece 180*a*. Relatedly, the second or extender piece 140*a* and the fourth or supporter piece 210 may be configured to together operate to counteract the force of gravity on a body of weight, to retain the device 100*a* in a stable position while the first or attacher piece 105*a* is attached to the elevated object. In some examples, the fourth or supporter piece 210 may be extended to contact the vertical object 205, or to contact a surface of the device 100*a* that in turn contacts the vertical object 205. Accordingly, in some embodiments the fourth or supporter piece 210 may apply force against the elevated object indirectly through a more disbursed force against a part of the article distinct from the supporter piece.

In some examples, the (fourth or) supporter piece may include or be a gusset 210. The gusset 210, for example, may have two ends 215, 220. A first end 215 may be connectable to or securely placeable against the bottom side 155*a* of the second piece 140*a*. A second end 220 may be connectable to/with, or securely placeable against, a side 225 of the vertical object 205 substantially facing towards the extended second end 220 of the (fourth or supporter) piece 210, or may otherwise place forces against the vertical object 205 through the second end 220 when forces are being applied to the first end 215.

More specifically, the orientation of the gusset 210 with respect to the vertical object 205 and the (second or) extender piece 140*a* may be such that a downward force applied on the (second or) extender 140*a* (and/or the third or weight suspension piece 180*a*) from the force of gravity on a weight or body of weight is transferred to the gusset 210. However, downward movement of the gusset 210 and (second or) extender piece 140*a* may be prevented by the second end 220 of the gusset 210 being connected to/with or securely placed against the vertical object 205.

In one embodiment, the second end 220 of the gusset 210 may be secured to the side 225 of the vertical object 205 (such as, for example, by another fastenable loop 230). In one particular embodiment, the first end 215 of the gusset 210 may be placed beneath the bottom side 155*a* of the second piece 140*a* near or at the second end 165*a* of the second piece 140*a*. In addition, the second end 215 of the gusset 210 may be securely fastened, connected, or placed a certain distance 235 below where the loop 110*a* is connected to the second piece 140*a*. Thus the forces from the In some examples, the gusset 210 may run substantially at an angle from the second end 220 of the second piece 140*a* to the side 225 of the vertical object 205 (although such angles may vary according to embodiment). In some examples the angle may range from 0 to 90 degrees, and in some examples, 15 to 75 degrees, in some examples, the angle may be 45 degrees or substantially 45 degrees.

In some embodiments, not only may the gusset 210 provide support to the second or extender piece 140*a*, but the second or extender piece 140*a* may also provide support to the gusset 210. For instance, in some examples, without the gusset 210, the extender piece 140*a* may not have the tensile strength by itself to support a load hanging from the third or weight suspension piece 180*a*; conversely, in some examples, without the extender piece 140*a*, the gusset 210, may not have the tensile strength by itself to support a load hanging the third or weight suspension piece 180*a*. In some examples, the second or extender piece 140*a* may help the gusset 210 maintain a proper alignment and help prevent the first end 215 from falling vertically.

In addition, in some examples, a large portion (if not most) of a downward force generated by the force of gravity on a load hanging from the third or weight suspension piece 180*a* will be transferred to the second end 220 of the gusset 210. As mentioned above, the second end 220 may be braced at a point along the vertical object 205 below where the attacher piece 110*a* connects or contacts the vertical object 205. Thus, by virtue of this design incorporating the second end 220, less force is applied to the point of area where the attacher piece 110*a* connects or contacts the vertical object 205, which may result in more sturdiness and less instability to the attacher piece 110*a*.

In some examples, the (fourth or) supporter piece 210 (that includes or may be a gusset) may be straight-shaped plate and in other examples may be curved. In some example, the (fourth or) supporter piece 210 may be made of at least partly from a solid, rigid material, which may at least partially include metal, such as one or more of aluminum, copper, or steel. Similarly, in some examples, other parts/pieces of the device 100*a* (such as the first or attacher piece 110*a*, the second or extender piece 140*a*, the third or weight suspension piece 180*a*) may also be made of similar materials, while the (fourth or) supporter piece 210 and other parts/pieces described herein may also be made of hardened plastic-based materials, and/or a combination thereof.

In some examples, the second end 155 of the (second or) extender piece 140*a* may be attached to the (third or) weight suspension piece 180*a*, which may include a bar 240. In some examples, the bar 240 may be attached to the second piece 140*a* in the transverse plane. In one particular example, the bar 240 may extend horizontally from the body of the second piece 140*a*, and at a ninety degree angle. The horizontal bar 240 may have two opposite ends 245, 250.

Figure 3B:
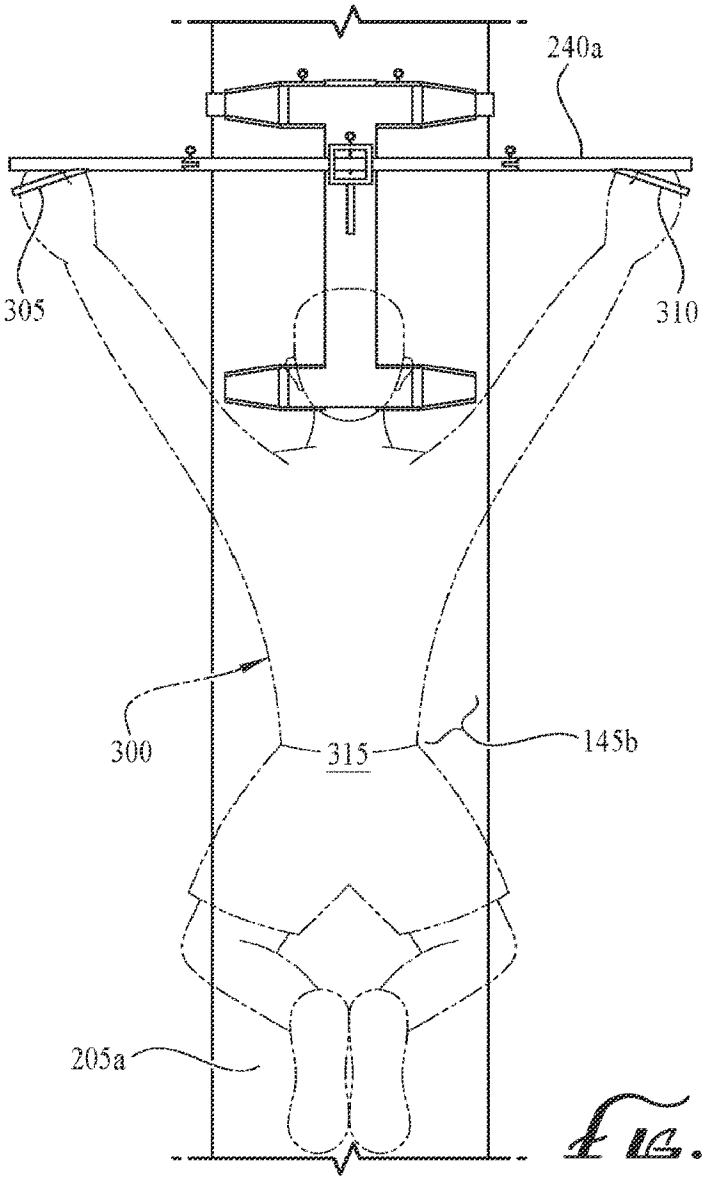
FIG. 3A-C illustrate front views of an exercise device embodiment being used for exercise in accordance with various aspects of this disclosure.
Figure 3A:
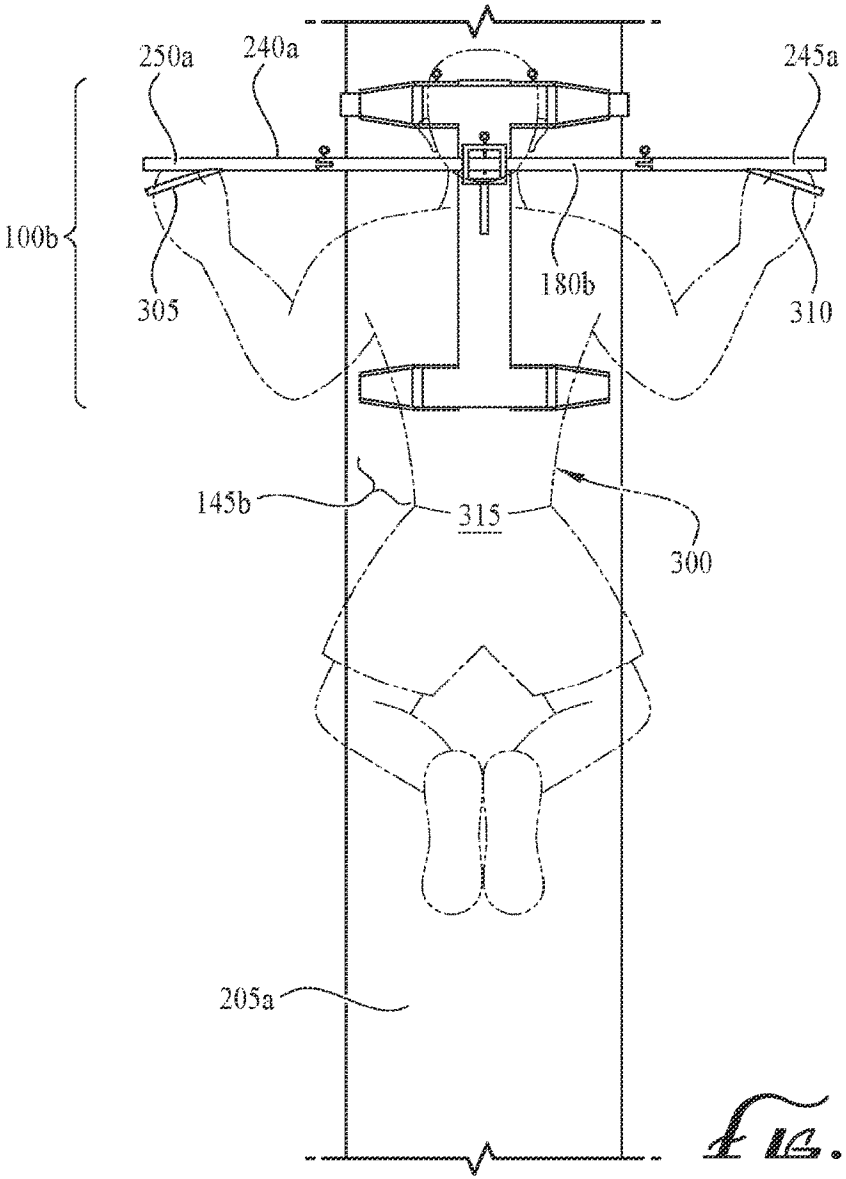

FIGS. 3A and 3B show the device 100*b* attached to a vertical object 205*a*, being used for exercise by a person 300, in accordance with various aspects of this disclosure. More specifically, two opposite ends 245*a*, 250*a* of a horizontal bar 240*a* of a (third or) weight suspension piece 180*b* may include handles 305, 310 at or towards each end 245*a*, 250*a* to grip for the performance of pull-ups. In some examples the handles 305, 310 may be made of polyurethane grip padding. Thus, in one embodiment a pull-up bar 240*a* may be suspended in air.

Figure 3C:
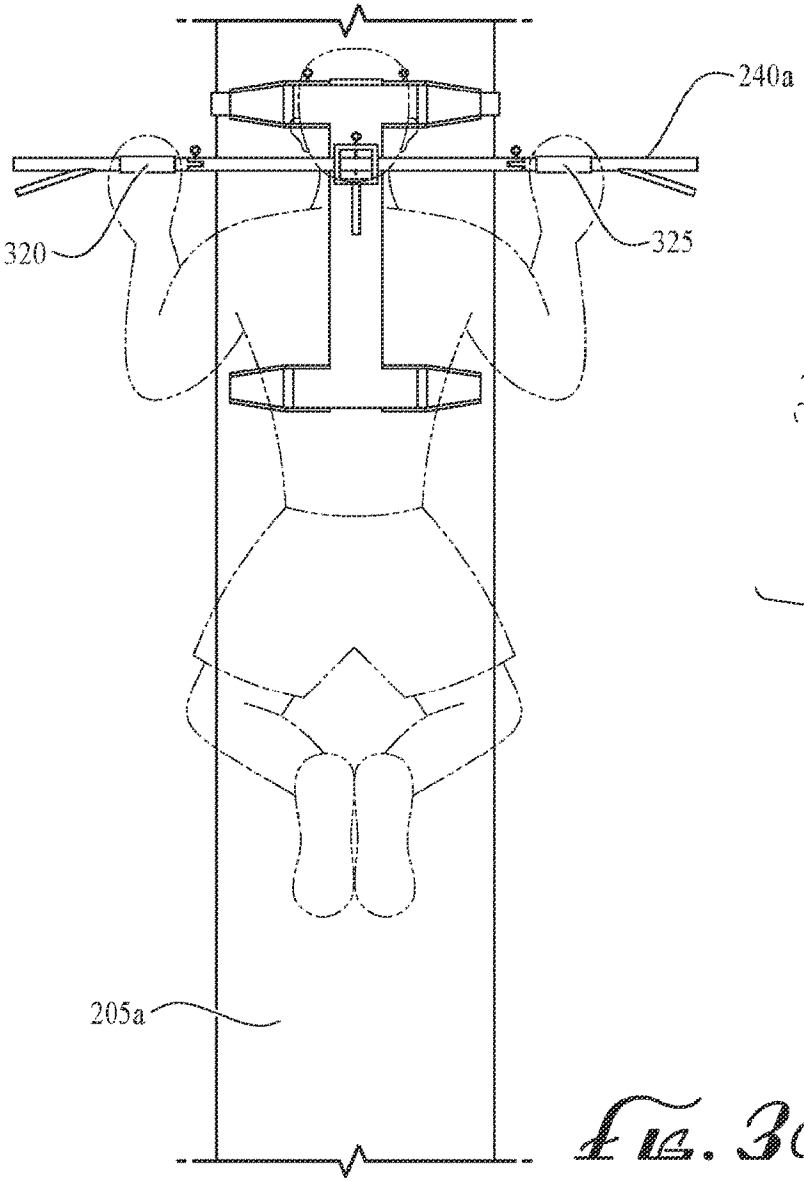

With a person 300 gripping the handles 305, 310 and performing a pull-up, the body or torso 315 of the person 300 may be located a sufficient horizontal distance 145*b* away from the vertical object 205*a* to avoid inadvertently bumping against the vertical object 205*a* as pull-up exercises are being performed. In one embodiment (shown), the handles 305, 310 or handle areas may be angled downward to allow a potentially-more comfortable sloping downward grip. In similar embodiments, the horizontal bar need not have a level straight (perfectly "horizontal") orientation, but may also have ends 245*a*, 250*a* that are curved slightly downwards. One embodiment may also include a second pair of handles or grips 320, 325, more closely spaced along the horizontal bar 240*a* for performing more close gripped pull-ups, as shown in FIG. 3C.

Figure 4A:
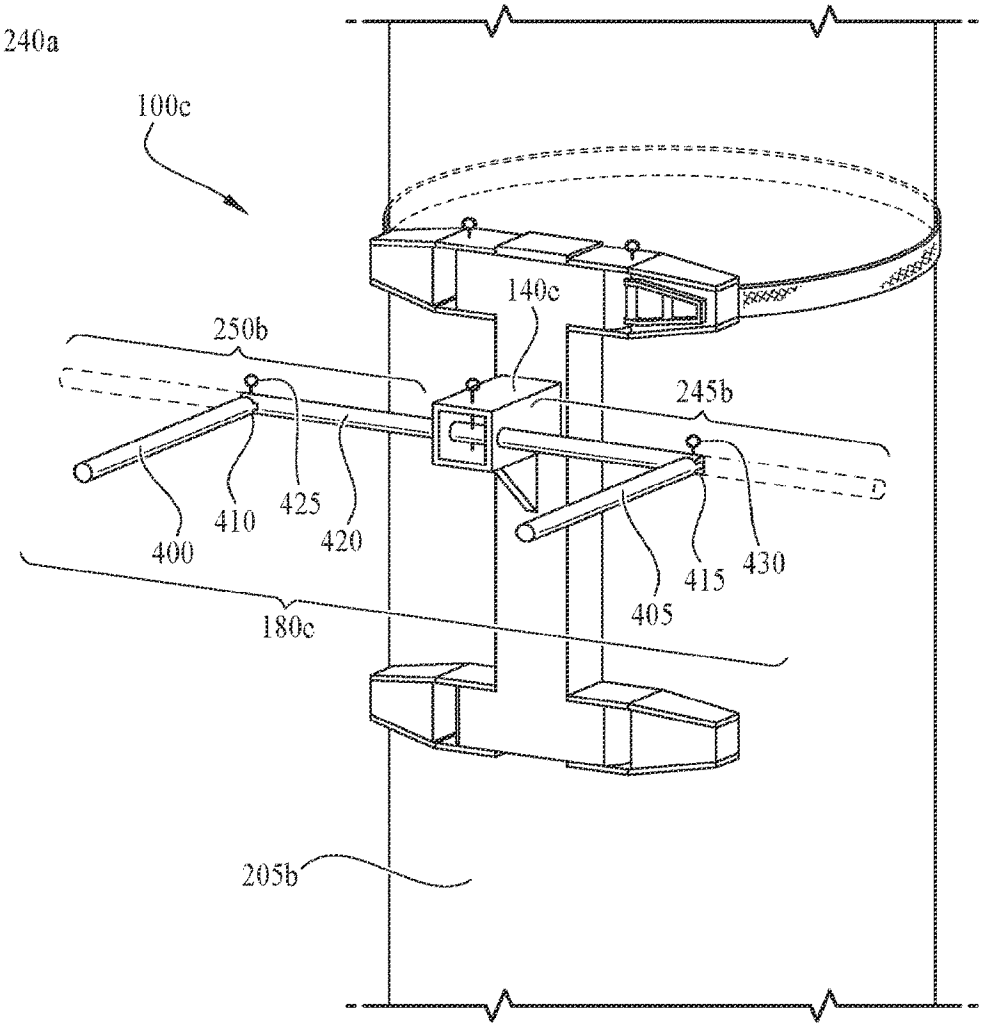
FIG. 4A-C illustrate front views of an exercise device embodiment with pivoting bar ends for performing additional exercises in accordance with various aspects of this disclosure.
Figure 4B:
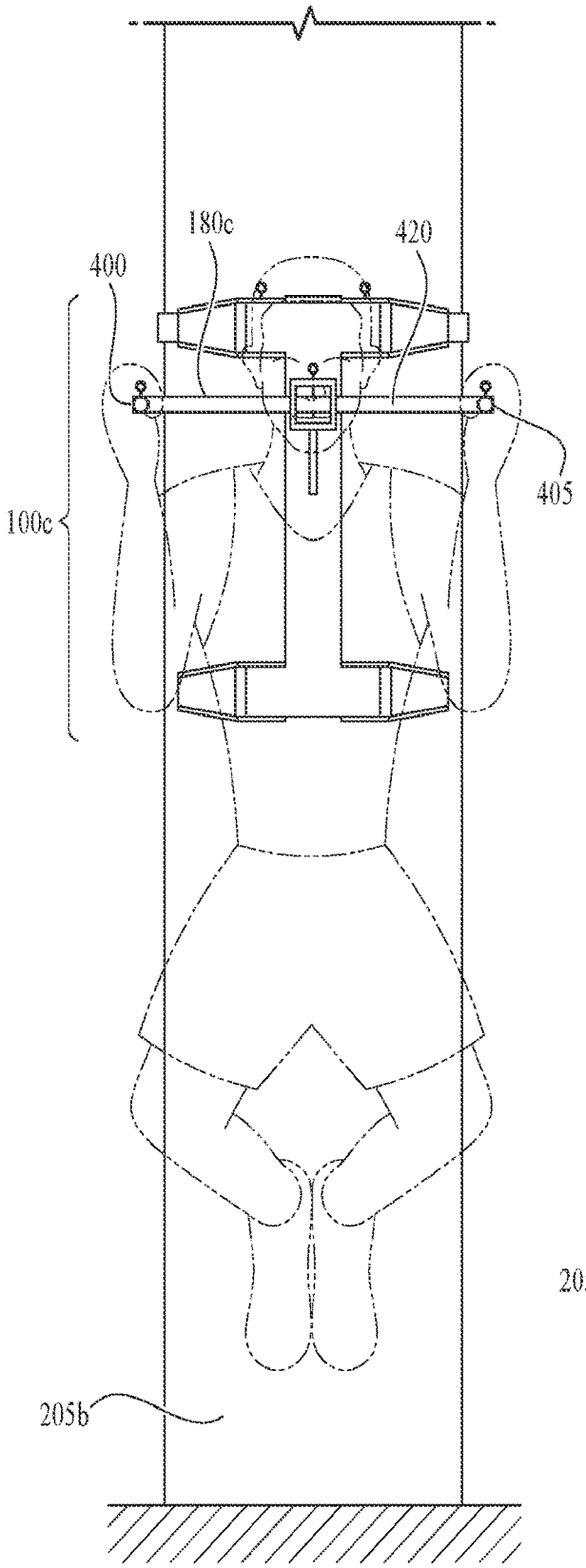

FIGS. 4A and 4B show the device 100*c* being used for additional exercises, in accordance with various aspects of this disclosure. As also shown in FIG. 4A, in one embodiment, the opposite horizontal bar ends 245*b*, 250*b* may also comprise rod portions 400, 405 and pivoters 410, 415 allowing each rod portion 400, 405 to pivot in a predetermined manner. In one embodiment, such pivoting is intended to occur inwardly along the transverse axis, so that the bar ends 245*b*, 250*b* point further away from the vertical object 205*b*, or in other words towards the direction from which the (second or) extender piece 140*c* is extending from the vertical object 205*b*. In one embodiment, the angle in the transverse plane between pivoted each rod portion 400, 405 on or towards each end of the horizontal bar 180*c*, and the central section of the horizontal bar 420, may be substantially ninety degrees so that each rod portion 400, 405 is perpendicular to the central section 420 of the horizontal bar 180*c*. In one embodiment, said pivoters 410, 415 may comprise elbow joints. Moreover, in addition to pivoters 410, 415, the horizontal bar 180*c* in one embodiment may also comprise locks 425, 430 so that the rod portions 400, 405 may lock into place either in the ninety degree angle-position (shown in FIG. 4B), or in the original position (shown in FIG. 4A) where the rod portions 400, 405 run in a substantially straight two dimensional line with the central portion 420.

Figure 4C:
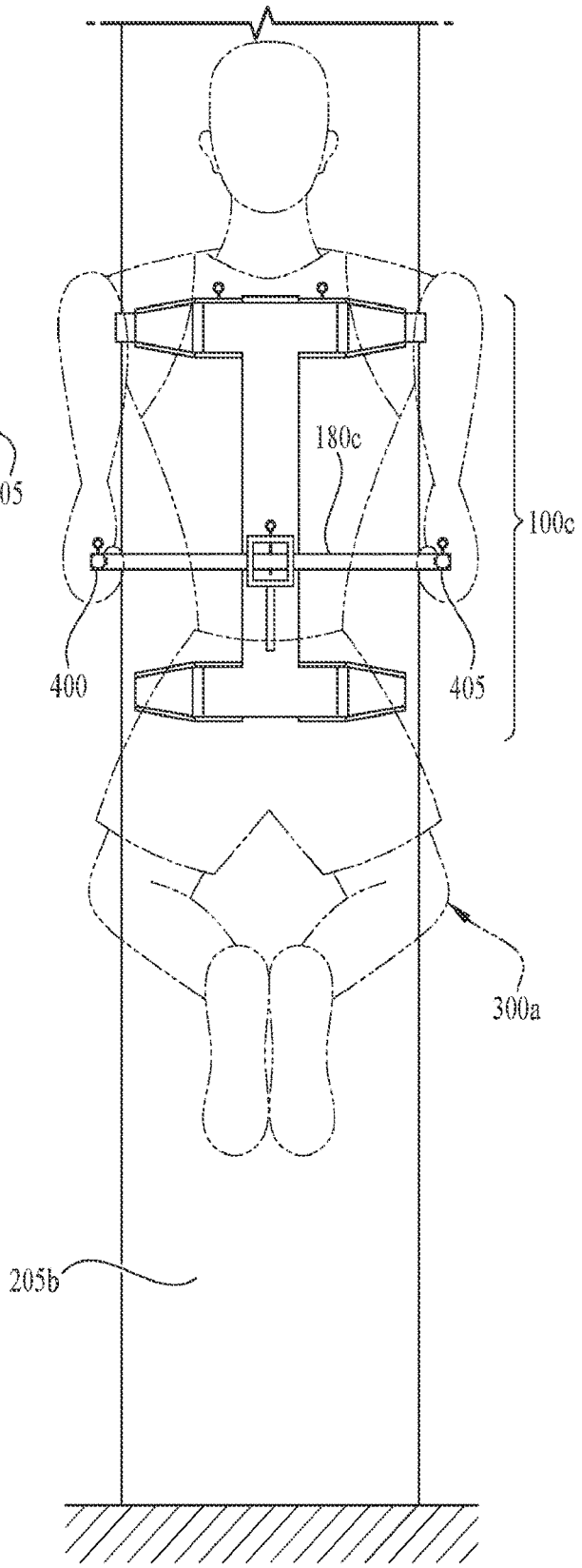

With the pivoted rod portions locked into the ninety degree angle position as shown in FIGS. 4B and 4C, the third piece 100*c* may provide a configuration for the performance of additional exercise. For example, as shown in FIG. 4B, a pullup may be performed that focuses more on shoulders. In addition, as shown in FIG. 4C, a dip exercise may be performed. Thus, in some examples, the device 100*c* may be a portable exercise machine that allows more than one type of gravity-based resistance muscle exercise using at least partially a person's own bodyweight.

Figure 5:
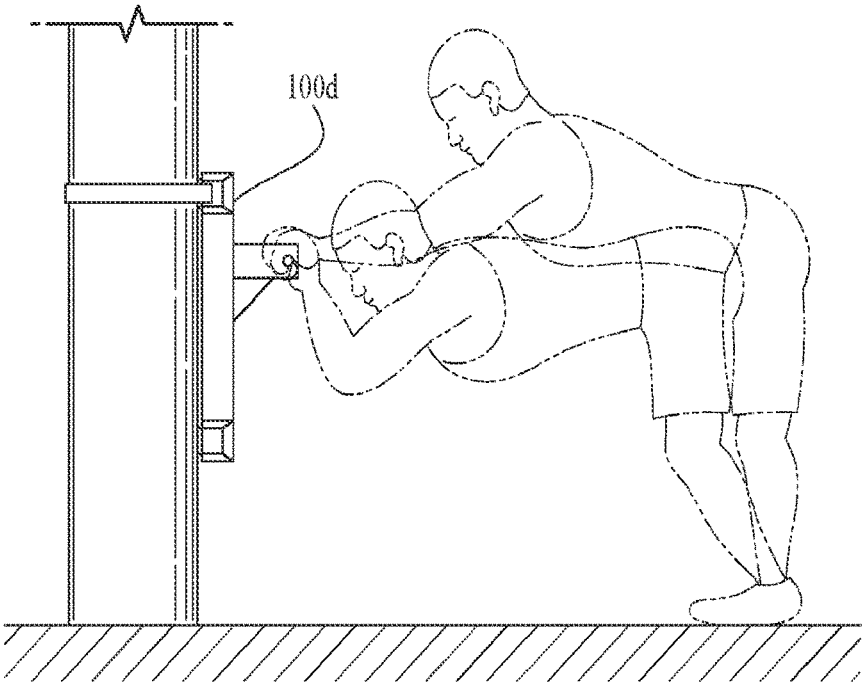
FIG. 5 illustrates side perspective views of an exercise device being used for additional exercise device in accordance with various aspects of this disclosure.

As shown in FIG. 5, some embodiments of the device 100*d* may be configured for performing different types of exercises, in accordance with various aspects of this disclosure. For example, some embodiments may be intended to engage the following indicated muscle groups: biceps (curls, close grip reverse pull-ups), triceps (close grip pushaways, wide grip push-offs), chest (incline and decline push-ups, dips), back (wide grip pull-ups, upside down), abs (hanging leg lifts, truck rotations), shoulders (shoulder press, front raises).

As shown in FIGS. 6, 7, 8A, and 8B, some examples of the device 100*e* may be a portable multi-exercise machine, in accordance with various aspects of this disclosure. For instance, some device 100*e* embodiments may be configured for carrying on a person's back and shoulders utilizing shoulder straps 705, and may be storable in a position conducive to such carrying. Some related embodiments may be a pseudo-backpack 600 (in FIG. 6), 700 (in FIG. 7) that can be carried similar to carrying a backpack. In addition, device 100*e* may have weight distributed equally down each side of a central axis 710 to allow for more comfortable carrying.

Figure 8A:
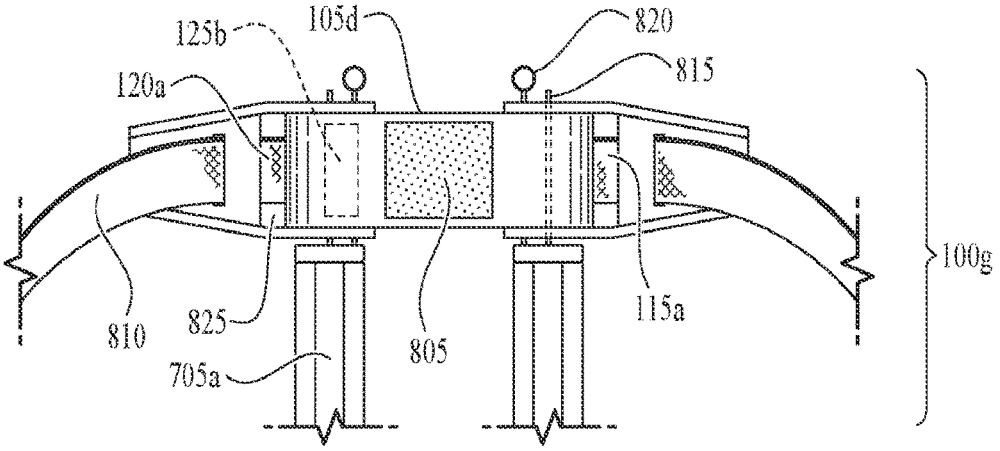

Also, the attacher piece 105*c*, which may constitute a substantial portion of the device's 100*e* weight, may be situated above the shoulder straps 705, so that when a person (not shown) carries the device 100*e* while wearing the shoulder straps 705, the weight of the attacher piece 105*c* is positioned slightly above and against the shoulders. In addition, as shown in FIG. 8A, the attacher piece may feature urethane 805 or other similar material along its surface that is configured for placement against the shoulders (or in some embodiments, against the back).

Figure 7:
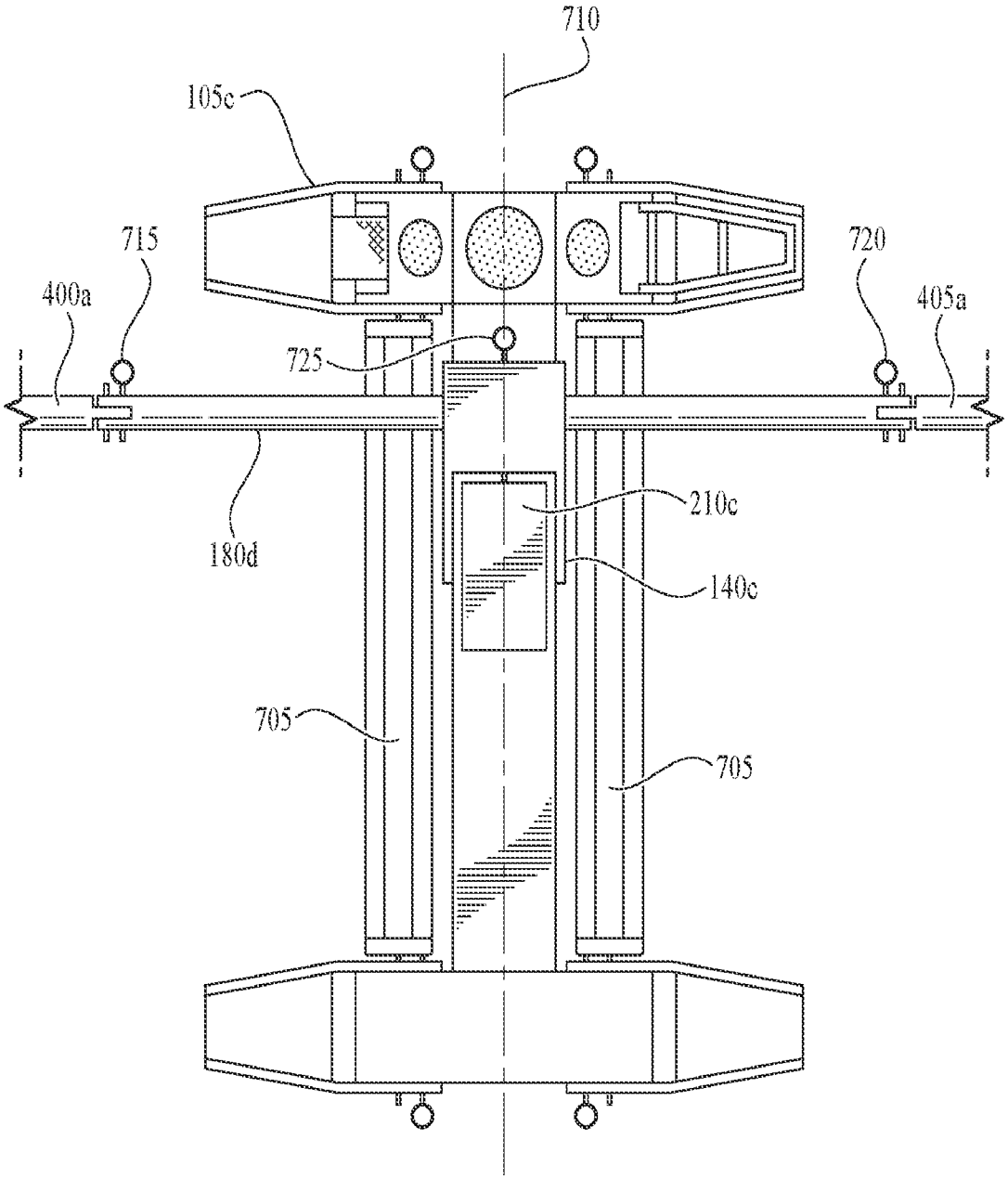

In addition, as shown in FIG. 7, the supporter piece 210*c* may fold into the extender piece 140*c*, for more compact portability. And the extender piece 140*c* may be configured so that it or a portion thereof lies against a person's back while wearing the shoulder straps 705. In addition, the extender piece may attach to or detach from the weight suspension piece using, for example, a pullpin 725.

Further the weight suspension piece 180*d* may include a horizontal bar, the outer rod portions 400*a* and 405*a* of which may fold or become detached. Thus, the full length of the bar 180*d* may not be extended outward to either side of a person while carrying the device 100*e*, which might otherwise bump or come into contact with trees or other objects while hiking or walking. In some examples, the rod portions 400*a*, 405*a* may fold or be secured into place in a straight position using pullpins 715, 720.

Figure 8B:
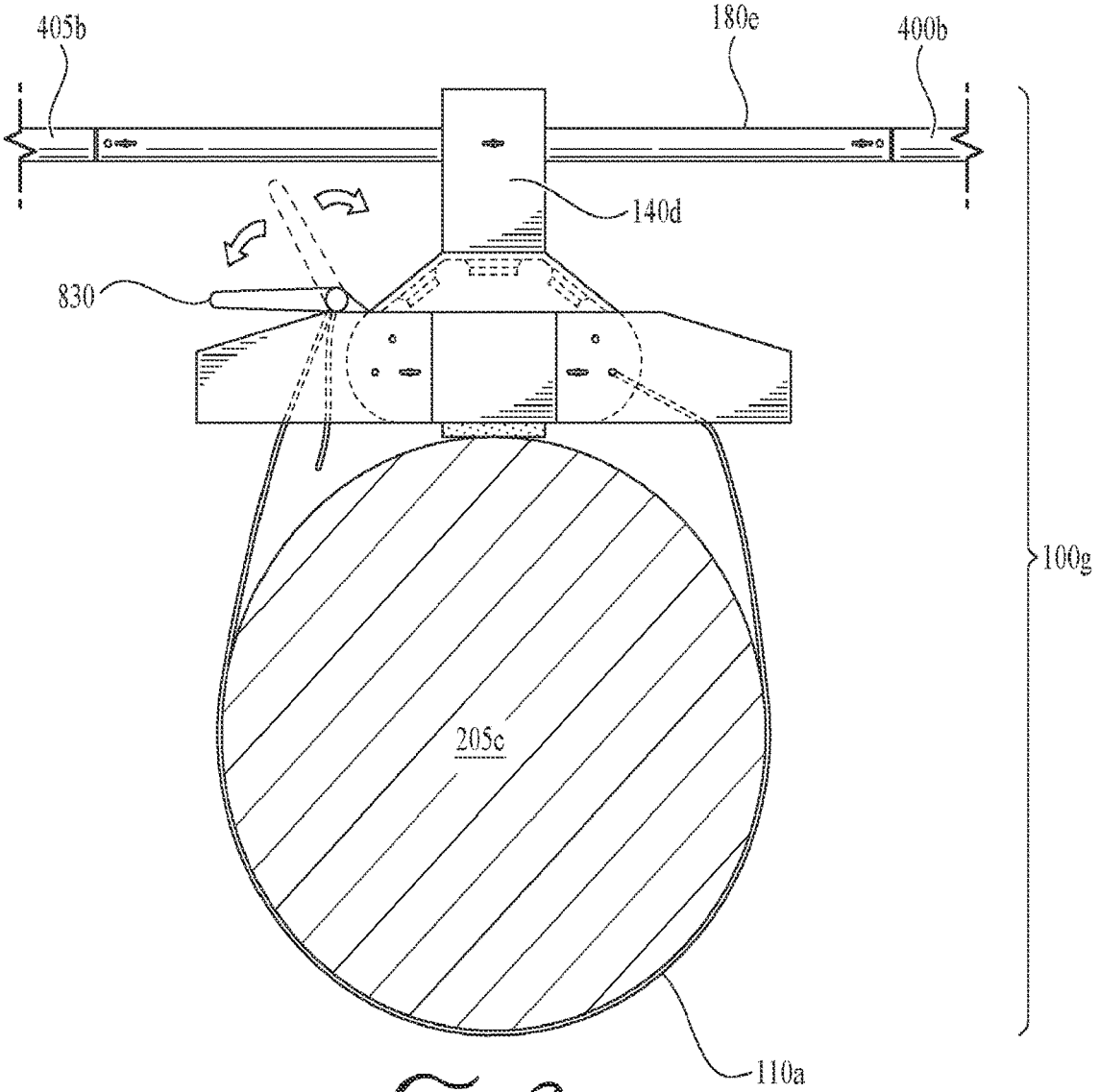

With the help of the aforementioned device embodiments one can carry the device 100*e* more easily to be able to perform different types of muscle exercises while also performing cardio exercise through walking, or running (whether or not carrying additional weights). More specifically, a person might go on a walk or a hike and also want to exercise their upper body muscles, and therefore set-up the device. Accordingly, as shown in FIG. 8A, the person may remove the device 100*g* from the shoulders and then remove the shoulder straps 705*a*. In some embodiments, the shoulder straps may be removed using a system of locking pins 820. Next the attacher piece 105*d* may include a strap 810, which in some examples may need to be assembled into the attacher piece 105*d* and/or a ratchet 125*b*. In some embodiments, this may occur by the first end 115*a* of the strap 810 mounting to the attacher piece 105*d* by means of a pivot bolt 815. In other examples, the strap 810, and the first end 115*a* thereof, may come pre-mounted to the pivot bolt 815. The second end 120*a* of the strap 810 may then be placed around an object 205*c* and fed into the ratchet side opening 825 of the attacher piece 105*d*, forming a loop 110*a* around the vertical object 205*c*. Then, as shown in FIG. 8B, the ratchet 125*b* may have a lever 830, which may be tighten the strap 810 around the object 205*c*. In addition, the extender piece 140*d* may be extended and locked into position, with the rod portions 400*b* and 405*b* of the bar 180*e* re-extended and locked securely into a straight position.

Accordingly, the device 100*g* may fasten the loop to a vertical object 205*c* such as a pole or a tree in the manner described above to provide suspended handles for performing pull-ups (or dips, in some examples, with the rod portions 100*b*, 405*b* in perpendicular positions to the rest of the bar 180*e*), or otherwise use the device to perform gravity based resistance muscle exercises, where resistance is generated at least in part by a user's own bodyweight. Once the muscle exercises are performed as desired, the person can conveniently detach the device 100*g*, continue the cardio exercise, and then repeat the steps as desired. Thus, the device 100*g* (and/or embodiments thereof) may allow cardio exercise to be combined with exercising muscles through gravity based resistance exercises, while potentially enjoying the great outdoors.

Figure 6:
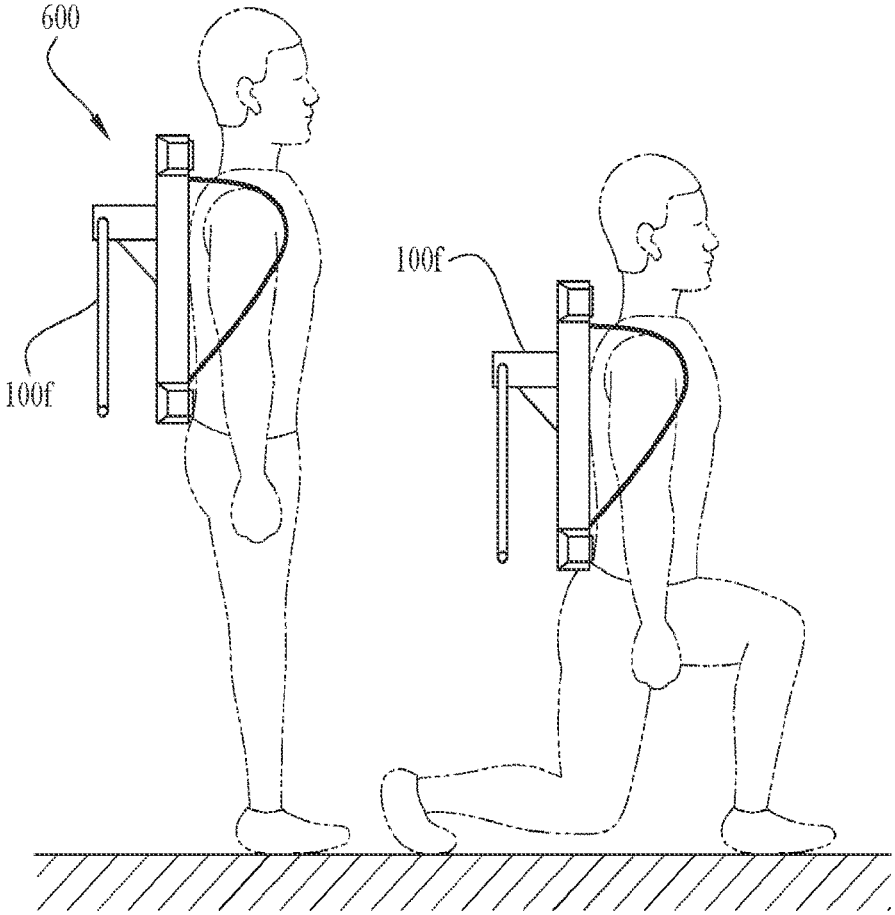
FIGS. 6-8B show an exercise device embodiment with straps that is carryable on a back in accordance with various aspects of this disclosure.

In addition, as shown in FIG. 6, the device's 100*e* portability may also provide opportunity for exercising additional muscle groups such as the leg muscles, as a person may use the weight from the device 100*e* to also perform lunges or squats.

Figure 9A:
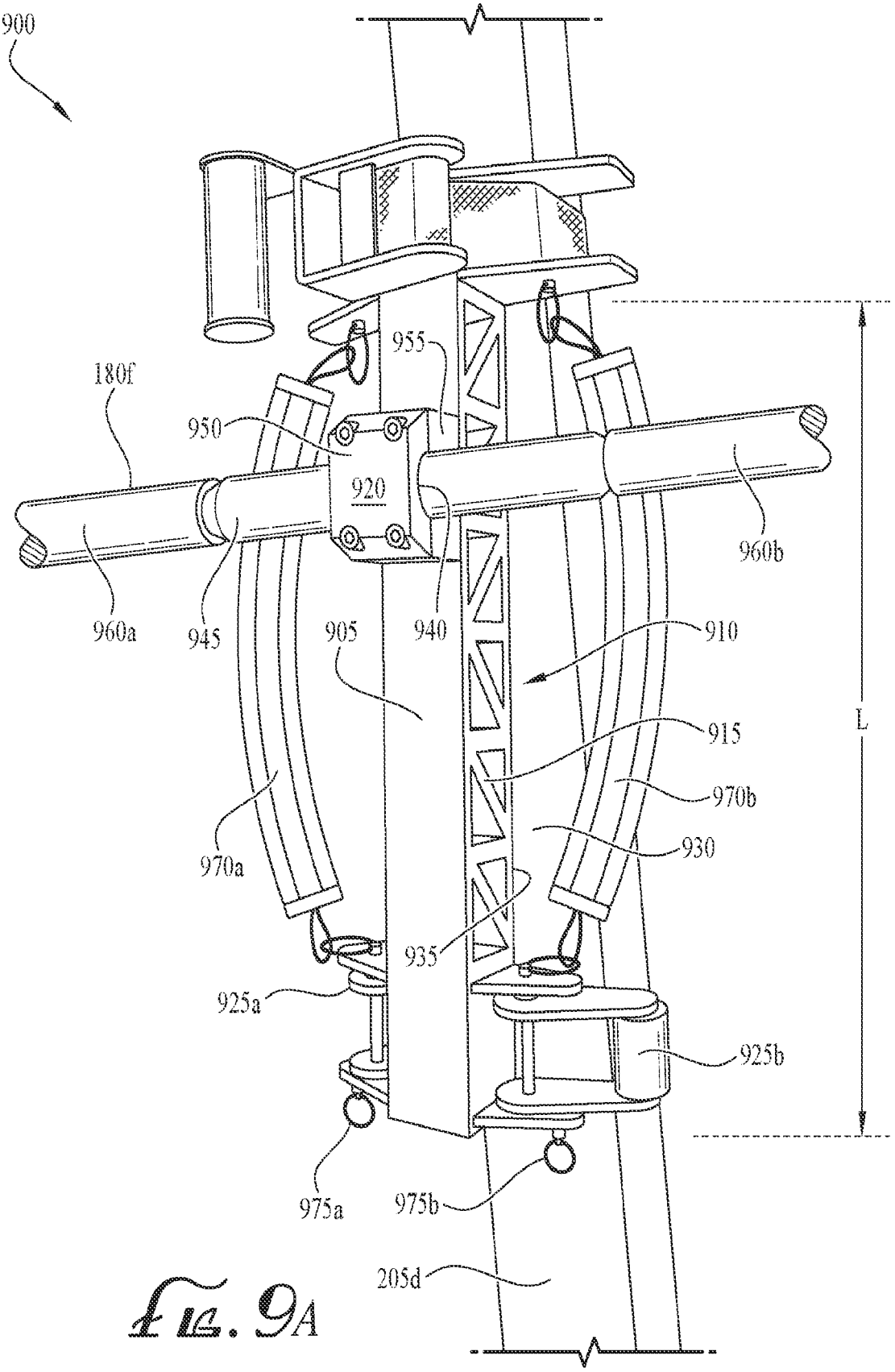
FIGS. 9A-9B illustrate two views of another exercise device embodiment in accordance with various aspects of this disclosure.
Figure 9B:
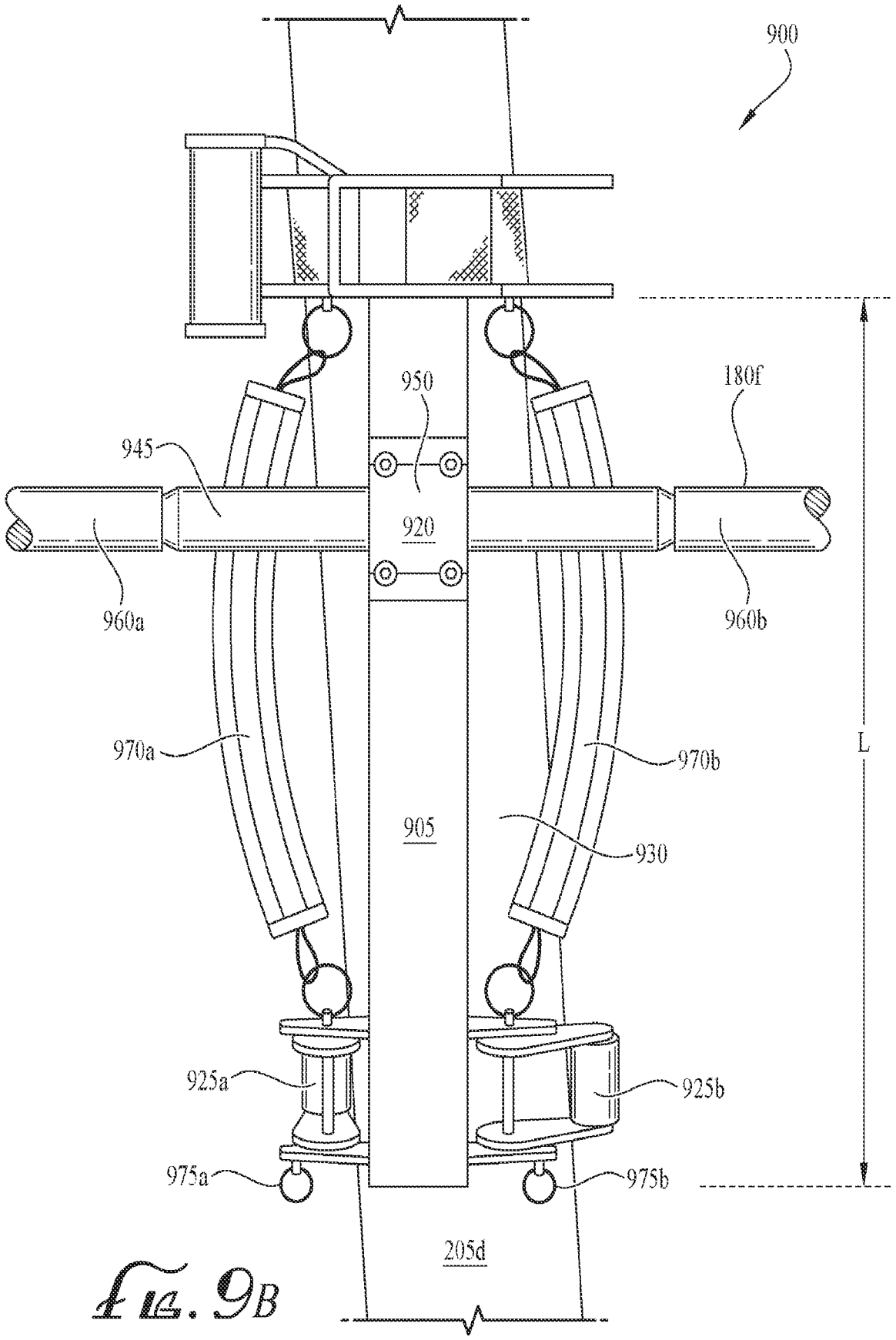

FIGS. 9A-9B show another exercise device embodiment 900 in accordance with various aspects of this disclosure. FIG. 9A is a front perspective view and FIG. 9B is a front view of the exercise device embodiment. The exercise device embodiment 900 may stably attach to a vertical object 205*d*, such as a metal post.

The exercise device embodiment 900 may include a main frame 905. In one example, the main frame 905 may have a volume made of sturdy, solid material such as metal. In some examples, such as that shown, the main frame 905 may have a rectangular-cubed structure. In some example, such as that shown, the main frame 905 may have a length L significantly greater than its width W (e.g., 4-20 times greater). Thus, the main frame 905 may be configured to align vertically with a post or other vertical object 205*d*. In some examples, the length L of the main frame 905 against the vertical object 205*d* may assist in dispersing forces over a larger area of the vertical 205*d*, which may be created while the exercise device embodiment 900 is in use (e.g., forces generated by the downward forces generated by the weight and/movement of a user performing pull-ups).

In some examples the main frame 905 may be configured to lie stably against the surface 930 of the vertical object 205*d*, so there is little or no empty space between the back surface 935 of the main frame 905 and the surface 930 of the vertical object 205*d* against which the main frame 905 is placed. Thus, in some embodiments, the surface 930 of the vertical object 205*d* may have a first shape (i.e., flat concave, convex, with certain degrees of curvature, etc.), and the back surface 935 of the main frame 905 may also have a second shape (i.e., flat concave, convex, with certain degrees of curvature, etc.) configured for placement against the surface 930 of the vertical object 205*d*. In some example, the first shape may be different from the second shape.

In some examples, the main frame 905 of the exercise device embodiment 900 may include a gusset support structure 910. The gusset support structure 910 may be designed to provide support to oppose the downward forces on the device generated by use. For example, the gusset support structure 910 may include a series of diagonal support braces 915 that may operate in accordance with general principles of gussets apparent to one of ordinary skill in the relevant arts and as described herein.

The exercise device embodiment 900 may also include bar clamp piece 920 for holding the bar 180*f* fixed solidly in place to permit little or no movement between the bar 180*f* and the bar clamp piece 920 while the bar 180*f* is being used to perform exercises. In some embodiments, the bar clamp piece 920 may include a receptacle 940 for receiving the bar 180*f*, or a portion thereof. For example, the receptacle 940 may have a shape for receiving a center or core portion 945 of the bar 180*f* in a fixed position. In some embodiments, the center or core portion 945 may be fixed to the receptacle 940 through a cap piece 950 of the bar clamp piece 920 bolted or screwed to a base piece 955 of the bar clamp piece 920.

Additional pieces 960*a*, 960*b* of the bar 180*f* may be attached and secured to the center or core portion 945. Such designs may allow easier and less awkward portability. Relatedly, the exercise device embodiment 900 may be configured for attaching backpack straps 970*a*, 970*b*. In some embodiments, each of the backpack straps 970*a*, 970*b*, may be configured to attach to both an upper portion (e.g., at or higher than the bar clamp piece 902) of the exercise device embodiment 900 and to a lower portion (e.g., at, or towards, or beneath the bottom of the gusset support structure 910).

At or towards the bottom of the main frame 905, the exercise device embodiment 900 may also include two bottom adjustable stabilizers 925*a*, 925*b*. The bottom adjustable stabilizers 925*a*, 925*b* may be configured for placement along either side of the vertical object 205*d*. In some embodiments, the position of the bottom adjustable stabilizers 925*a*, 925*b* may be selected to be in one of several fixed positions (using for examples, holes and pins 975*a*, 975*b* for locking into the holes), depending on the size or width of the vertical object 205*d*. In some examples, the bottom adjustable stabilizers 925*a*, 925*b* may made of metal and/or rubber.

Device embodiments may also allow performance of a method of using certain vertical objects to perform gravity-based exercises in the manner described above. For instance, the method include: attaching an attacher piece to an elevated object at a vertical point along the elevated object; extending an extender piece to extend a horizontal distance from the elevated object while the attacher piece is attached to the elevated object and while the extender piece is connected to the attacher piece; suspending a body of weight from a weight suspension piece while the weight suspension piece is connected to the extension piece; and extending a supporter piece from at least one of the extender piece and the weight suspension piece to apply force against the elevated object below the vertical point at which the attacher piece is attached to the elevated object, to provide additional support for the suspension of the body of weight from the weight suspension piece.

"Side" is defined herein to mean any surface of an object and is not limited to a flat surface but rather may take any shape, such as a curved surface. The term "horizontal bar," as used herein need not be strictly "horizontal" in a rigid sense of the word but rather is used solely for purposes of identification of the piece having handles as described herein.

The above description and listed alternative embodiments are considered that of some embodiments only. It is understood that the embodiments shown in the drawings and described below are merely for illustrative purposes and not intended to limit scope. Thus, alterations and modifications and such further applications as would occur to those skilled in the relevant art(s), are also contemplated. For example, combinations of features between the embodiments shown in the figures and described above are contemplated.

Although the foregoing detailed description contains many specifics for the purpose of illustration, a person of ordinary skill in the art will appreciate that many variations and alterations to the foregoing details can be made and are considered to be included herein. Accordingly, the foregoing embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

An initial overview of the technology is provided below and specific technology embodiments are then described in further detail. This initial summary is intended to aid readers in understanding the technology more quickly, but is not intended to identify key or essential features of the technology, nor is it intended to limit the scope of the claimed subject matter.

The invention claimed is:

1. An article for performing exercise, comprising:

an attacher piece to attach to an elevated object at a first vertical coordinate;

an extender piece to extend a horizontal distance from the elevated object while the attacher piece is attached to the elevated object and while the extender pieces is connected to the attacher piece;

a weight suspension piece configured to be gripped by hands of user to suspend a body of weight therefrom while the weight suspension piece is connected to the extender piece, wherein the extender piece and the weight suspension piece are non-linearly aligned in a horizontal plane extending through the extender piece, the weight suspension piece having an adjustable length; and a supporter piece comprising a gusset support structure, wherein the supporter piece is configured to extend from a second vertical coordinate at or below the first vertical coordinate and configured to extend to a third vertical coordinate below the second vertical coordinate, and provide additional support for the suspension of the body of weight from the weight suspension piece, wherein the supporter piece comprising the gusset support structure, is foldable into the plane of the extender piece.

2. The article of claim 1, wherein the supporter piece is configured to extend from the at least one of the extender piece and the weight suspension piece at an angle from the horizontal axis of the extender piece while the extender piece extends a horizontal distance from the elevated object while the attacher piece is attached thereto.

3. The article of claim 2, wherein the angle is in a range of 15 to 75 degrees.

4. The article of claim 1, wherein the supporter piece is attached to and extends from at least one of the extender piece and the weight suspension piece.

5. The article of claim 1, wherein the extender piece has a proximal end and a distal end opposite the proximal end, and wherein the attacher piece is connected to the proximal end of the extender piece, and wherein the weight suspension piece is connectable to the extender piece at the distal end of the extender piece.

6. The article of claim 1, wherein the supporter piece is configured to apply force on the elevated object at the third vertical coordinate.

7. The article of claim 6, wherein the supporter piece is further configured to apply the force against the elevated object by at least some direct contact with the elevated object at the third vertical coordinate.

8. The article of claim 1, wherein the attacher piece and the extender piece are separate pieces.

9. The article of claim 1, wherein the weight suspension piece is configured to be aligned horizontally perpendicular from the extender piece.

10. The article of claim 1, wherein the extender piece extends the horizontal distance from the elevated object at a fourth vertical coordinate at or above the second vertical coordinate and the extender piece does not extend vertically below the second vertical coordinate.

11. The article of claim 1, wherein the extender piece and the weight suspension piece are separate pieces.

12. The article of claim 2, wherein the angle includes a range of 85 to 95 degrees from a vertical axis of the elevated object.

13. The article of claim 1, wherein the weight extension piece comprises at least a first pair of hand grips.

14. The article of claim 13, wherein the weight extension piece comprises a sturdy bar comprising a first end and a second end.

15. The article of claim 14, wherein the at least a first pair of hand grips comprises a firsthand grip and a corresponding second hand grip, and the first end of the sturdy bar comprises the first hand grip and the second end of the sturdy bar comprises the second hand grip.

16. The article of claim 15, wherein each hand grip of a first pair of the at least a first pair of hand grips are attached to a pair of extending rod portions associated with the sturdy bar and configured to extend in a substantially similar direction as the extender piece to horizontally-aligned positions with respect to the bar.

17. The article of claim 16, wherein the pair of extending rod portions are distinct from the first end and the second end of the sturdy bar, and wherein the first pair of the at least a first pair of hand grips attached to the pair of extending rod portions are distinct from the first hand grip and the second hand grip.

18. The article of claim 1, wherein the attacher piece is configured to form a loop to wrap around the elevated object.

19. The article of claim 17, where the attacher piece comprises a first end and a second end, the first end attachable to the second end to form the loop, and attacher piece further comprises a tightener associated with one or both of the first end and the second end.

20. The article of claim 1, wherein the gusset support structure comprises a first end and a second end opposite the first end and comprises at least one gusset brace having a straight shape between the first end and the second end, wherein the supporter piece is configured to extend from the second vertical coordinate at or below the first vertical coordinate at the first end of the gusset support structure and configured to extend to the third vertical coordinate below the second vertical coordinate at the second end of the gusset support structure, and wherein the supporter piece is configured to provide the additional support based at least in part on the gusset support structure.

* * * * *